US008327908B2

(12) United States Patent
Godovalov

(10) Patent No.: US 8,327,908 B2
(45) Date of Patent: Dec. 11, 2012

(54) SECTIONAL FOLDING UP GARAGE DOOR

(76) Inventor: Vladimir Godovalov, Konotop (UA)

( * ) Notice: Subject to any disclaimer, the term of this patent is extended or adjusted under 35 U.S.C. 154(b) by 183 days.

(21) Appl. No.: 12/658,546

(22) Filed: Feb. 9, 2010

(65) Prior Publication Data

US 2010/0287840 A1 Nov. 18, 2010

(30) Foreign Application Priority Data

May 15, 2009 (UA) ..... 200904758

(51) Int. Cl.
*E05D 15/00* (2006.01)

(52) U.S. Cl. ..... 160/201; 160/35; 160/188

(58) Field of Classification Search ..... 160/36, 160/207, 201, 183, 188, 35, 32, 187, 203, 160/204, 211–213
See application file for complete search history.

(56) References Cited

U.S. PATENT DOCUMENTS 1,833,252 A * 11/1931 Hayman ..... 160/190
1,872,489 A * 8/1932 Mitchell ..... 160/191
1,892,340 A * 12/1932 Guth ..... 160/147
1,962,913 A * 6/1934 Rutledge ..... 160/190
2,020,544 A * 11/1935 Gill et al. ..... 160/191
2,423,987 A * 7/1947 Levikow ..... 160/35
2,786,523 A * 3/1957 Phillips ..... 160/191
2,909,718 A * 10/1959 Lawick ..... 318/266
3,270,572 A * 9/1966 Zimmerle et al. ..... 74/89.22
3,280,888 A * 10/1966 Davis ..... 160/35
3,344,837 A * 10/1967 Young ..... 160/189
3,494,406 A * 2/1970 Roodenburg et al. ..... 160/188
3,618,656 A * 11/1971 Young ..... 160/9
3,678,985 A * 7/1972 Kummerman ..... 160/188
3,757,845 A * 9/1973 Pagliaro ..... 160/189
4,303,117 A * 12/1981 Lindbergh ..... 160/189
4,374,537 A * 2/1983 Lindbergh ..... 160/189
4,460,030 A * 7/1984 Tsunemura et al. ..... 160/35
4,610,289 A * 9/1986 Sugihara ..... 160/35
5,065,806 A * 11/1991 Kondoh ..... 160/36
5,172,742 A * 12/1992 Iwasaki et al. ..... 160/36
5,685,355 A * 11/1997 Cook et al. ..... 160/202
5,893,403 A * 4/1999 Megens ..... 160/35
7,089,989 B2 * 8/2006 Pfender ..... 160/195
2002/0084041 A1 * 7/2002 Craig ..... 160/35
2005/0072537 A1 * 4/2005 Pfender ..... 160/211
2010/0282418 A1 * 11/2010 Lucas ..... 160/54

* cited by examiner

*Primary Examiner* — Katherine W Mitchell
*Assistant Examiner* — Johnnie A Shablack
(74) *Attorney, Agent, or Firm* — Larisa Migachyov

(57) ABSTRACT

A sectional folding up garage door refers to constructions with moving sectional elements intended for closing apertures in buildings and edifices. The area of invention's application is its use as automatically operated door both for private and commercial use. A sectional folding up garage door provides the sectional panel lifting up in vertical plane, folding such panel in consecutive order by two sections inside a premise as the door is being lifting, and piling compactly inside in the top part of an aperture. The door includes a panel of sections joint one by one like an accordion, a frame and sections power mechanism.

6 Claims, 8 Drawing Sheets

SECTIONAL FOLDING UP GARAGE DOOR

CROSS-REFERENCE TO RELATED APPLICATION

This U.S. patent application claims priority under 35 U.S.C. 119 (a) through (d) from Ukrainian patent application No. UA200904758 filed May 15, 2009 (now Ukrainian Patent No. 45054 issued Oct. 26, 2009), which application is hereby incorporated by reference in its entirety.

FIELD OF THE INVENTION

The present invention relates to overhead sectional doors of the type used to close large openings in garages and commercial buildings.

BACKGROUND OF THE INVENTION

Sectional folding doors are well known in the art and are widely used all over the world. Typically, such a sectional door comprises a plurality of rectangular panel sections, the total area of which is equal to the area of the aperture that needs to be closed, and the width of which is close to the width of the aperture that needs to be closed. The panel sections are joined to each other at their longitudinal edges with hinges that can be flexed in only one direction with a maximum angle of no more than 90°. The average thickness of such sections is typically about 40 mm, and they are made of lightweight aluminum or plastic. The door moves on two lateral rails by means of rollers. The rails have three sections—vertical, transitional/bending, and horizontal. When the door is vertical, the sections make a solid panel, closing the aperture. When the door is opening, the sections move up, pass the transitional/bending section, and move into the top horizontal surface. When the door is in the horizontal position, it is situated under the ceiling and above the user. The door area remains invariable—the sections of the garage door occupy the same amount of space both in the open and closed positions. Because of this property, the prior art door occupies a lot of space when the aperture is open, which may not be practical in every application.

SUMMARY OF THE INVENTION

The object of the present invention is to reduce the area occupied by the garage door when the door is open while preserving the vertical plane of motion while the door is opening or closing and requiring no free space in front of or behind the door while it is opening or closing.

The preferred embodiment of the invention comprises a sectional door comprising a plurality of panels, a frame, and a power mechanism. This embodiment of the invention allows the door to assume two static conditions—the closed door where all the panels are unfolded, and the open door where the panels are folded into a configuration that has the width and length of the biggest panel and the thickness approximately equal to the sum of the thicknesses of the panels. Also, as the panels move from the open to the closed condition, or vice versa, they move in the vertical plane. As the door opens, the panels fold one section at a time and move upwards, resting one below the other.

The sectional door comprises an even number of panels of similar width, connected sequentially at the top and bottom sides by means of alternating internal and external hinges. This enables the door to fold like an accordion. Roller mechanisms are placed on the lateral sides of the panels in reverse diagonal order with respect to the position of the hinges, to make it possible to fold the door compactly. On the lateral side of the door panels, there is an external and internal row of roller mechanisms. The top external roller mechanism on the first panel (topmost panel) comprises a cable roller, an external rail roller, and a lateral fork hinge placed coaxially; the bottom internal roller mechanism on the first panel comprises a cable roller and an internal rail roller, also placed coaxially. On the second panel, one cable roller is placed in the top internal position and one cable roller is placed in the bottom external position. This prevents interference when the second panel is folded up, and provides the roller mechanisms with up to three connection means. Each panel's roller mechanism comprises a cable roller. The topmost panel's roller mechanisms (both internal and external) also comprise internal and external rail rollers, enabling the motion of the panel along the rails; and a lateral fork hinge that is placed only behind the external rail roller, which comprises a U-slot on is surface, where the semicircular part of the U-slot is concentric with the internal hinge line, and where the lateral fork hinge rotates around the axial branch that is placed on the frame's external rail. This lateral fork hinge can connect and disconnect to the axial branch, and therefore, the topmost panel can rotate around the axial branch as it moves inside the premises. This arrangement of rollers repeats on other pairs of panels throughout the door; the only difference is the length of the internal and external rail rollers; for each pair of panels, going from top to bottom, the external rail roller length increases proportionally. For the internal rail rollers, the shortest roller is on the bottom-most pair of sections, and the roller length increases for each pair of panels going from bottom to top. On the bottom-most panel, two supplementary end rollers are used, situated on the same horizontal line—an end roller and a retaining roller. Both the end roller and the retaining roller are longer than the external rail roller's maximal length, and there is a minimal clearance between the roller's front side and the external rail, which prevents any blockage of the roller during its movement. The retaining roller's diameter is smaller than the rail roller's diameter. The function of the retaining roller is to prevent the bottom-most section from turning inwards.

The frame of the garage door of the present invention comprises vertical and horizontal sectors. The vertical sector comprises an external rail, with axial branches, and an internal rail, with curved sectors. The external rail rollers roll along the external rail with axial branches, where the increased length of the rollers correspondingly increases the distance of the lateral fork hinge from the external rail. The axial branches are placed in the top sector of the external rail. The axial branches are placed vertically, one above the other, at a distance that is the same as the distance between neighboring external rail rollers when the panels are folded. These axial branches serve as axes of rotation for the lateral fork hinges. Their position is such that each lateral fork hinge can only couple with its own corresponding axial branch, when its corresponding pair of sections starts to rotate inside and then fold. When the door is folded, all the lateral fork hinges are coupled with the relevant axial branches, and when the section is horizontal, the lateral fork hinge performs a locking function as it turns 90°. The axial branch is always higher than the vertical segment of the top curved sector of the internal rail, to prevent any interference with the internal roller along its motion path. This property necessarily limits the maximal quantity of the panel sections; the total thickness of all the panel sections cannot exceed the width of a section.

The internal rail comprises a straight vertical sector and curved sectors, whose quantity is the same as the quantity of the internal rail rollers. Each curved sector comprises three segments—a vertical segment, a reverse concave segment, and a circular segment whose radius of curvature is the same as the section width, and which is equal to the distance from the lateral fork hinge semicircle axis to the rotation axis of the panel's internal rail roller, plus the roller's radius. The curved sector of the internal rail is there to perform a retaining function; it is shaped so that the roller, when moving along the curved section, presses the lateral fork hinge against the axial branch. Each pair of panels has its own unique location for the curved sector, which depends on the internal rail roller length and the height of the axial branch for that pair of panels. The shortest internal rail roller is placed on the bottom-most pair of panels of the door, and rolls up on the internal rail's vertical sector, continuing onto the curved sector. The next pair of panels utilize a different curved sector, which does not coincide with the internal rail's vertical sector; it is displaced laterally to meet the other internal rail roller. The bottom of the curved sector has a reverse concavity segment of the same radius, to provide free motion of the internal rail roller when the door is closing. The length and inclination angle of that reverse concavity segment are what defines the U-slot length and the inclination angle of the internal edge of the lateral fork hinge slot. The end roller rail, situated between the internal and external rails, tracks the motion of the end roller of the bottom-most panel. The end roller rail has a length equal to twice the width of the panel.

The horizontal sector of the frame is as wide as the width of one panel, and it is connected to the external rail on its front side and to the curved sectors of the internal rail on the rear side. A rotary support is placed inside said frame to support the U-slots as they rotate; it is axially fixed inside the frame's horizontal sector through the rear ends of the lateral sides, and connected to the panel's top sections via the internal hinge line. The rotary support rotates within the horizontal coupling, and the lateral fork hinge of the first pair of panels is connected with the axial branch of the first pair of panels at the beginning of the folding process, and rotates downwards until the internal rail roller of the first pair of panels is placed on the vertical segment of the internal rail's curved sector. This prevents any inward bending of the first pair of panels, and enables the door to lock in place. The traction rollers are placed on the horizontal sector of the frame above the internal rail rollers when the door is folded. The lifting rollers are placed on the lateral sides of the frame above the external rail rollers when the door is closed. The lifting rollers, together with the rotary support, implement the door locking mechanism. The winding drum is placed on the horizontal sector of the frame behind the traction rollers. In another embodiment of the invention, it can also replace the traction rollers and execute both their function and the cable winding function simultaneously. The power mechanism comprises the following elements: the cable winding drum, two lifting rollers, and two traction rollers, all situated on the horizontal sector of the frame; cable rollers placed on the panels; and two cables. The cable winding sequence starts with the first pair of panels as follows: winding drum—traction rollers—bottom internal roller of the first panel—lifting roller—bottom external roller of the second panel—top internal roller of the second panel. The cables are fixed at that point if this is the last pair of panels, or go on to the next pair of panels—bottom internal roller of the first panel—top external roller of the first panel—bottom external roller of the second panel—and so on. The diagonal position of the cable rollers prevents their touching the cable. The advantages of this design are increased hoisting capacity as a result of the use of two cables, which enables a sturdier design for the door panels and extends the maximum allowable aperture area to be closed; and the fact that the design uses the weight of the door panels during the opening and closing process, rather than the prior art spring mechanisms, which improves reliability and safety. Further advantages are faster opening and closing due to the reduction of the guide rail length and noise reduction during opening and closing as a result of the absence of horizontal motion.

DETAILED DESCRIPTION OF THE PREFERRED EMBODIMENT

The foregoing description is that of the preferred embodiment of the present invention, and not meant to be limiting. Other embodiments of the invention exist and are apparent to a person of ordinary skill in the art.

Figure 1:
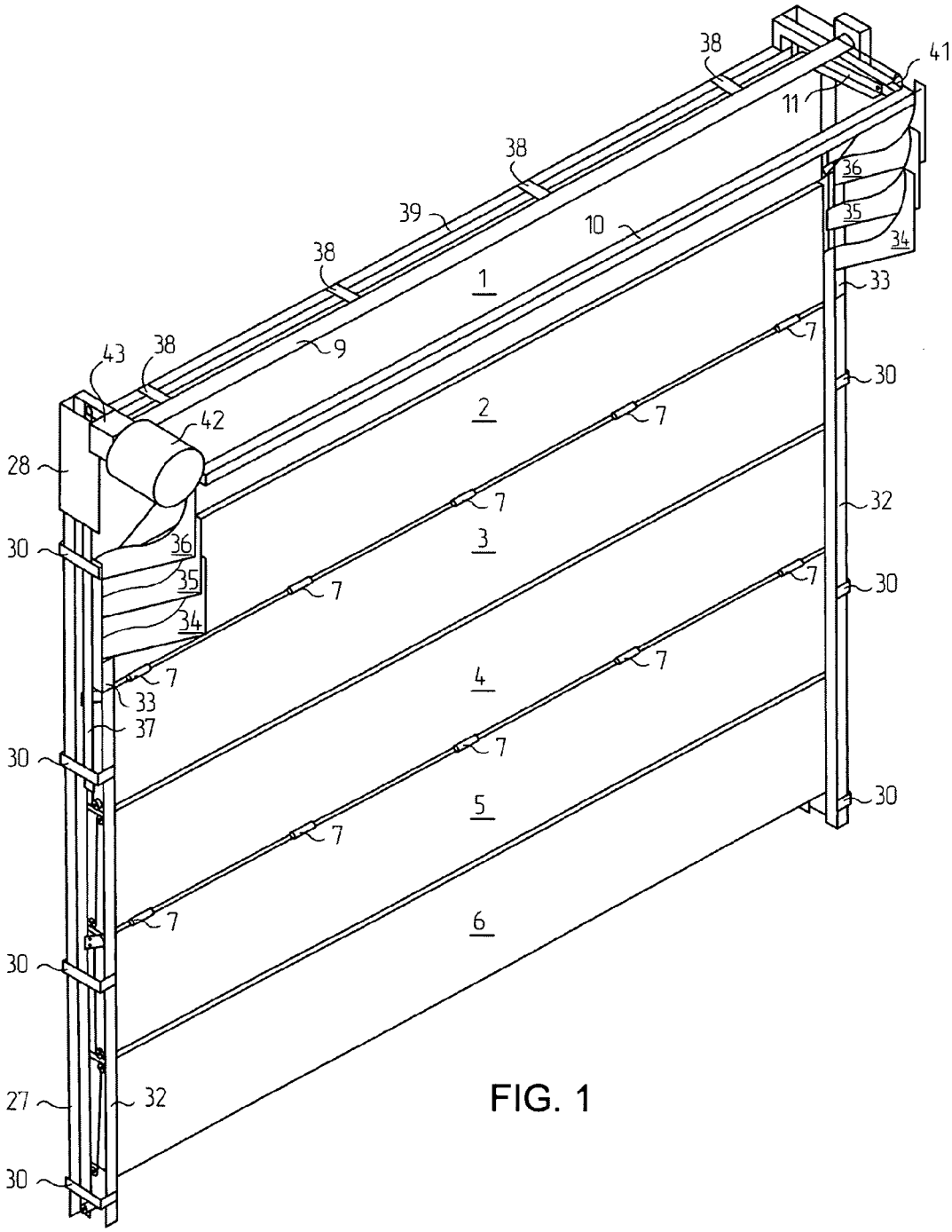
FIG. 1 is a perspective view of the invention.

FIG. 1 shows the garage door of the present invention. The aperture of the garage is closed by panels 1, 2, 3, 4, 5, and 6 (note that the number of panels does not have to be 6, and can be any number). The frame comprises an external rail 27 with axial branches that are placed on platform 28, and internal rail 32 with curved sectors 34, 35, and 36 and the end roller rail 37. All the rails are connected with clamps 30. Horizontal sector 10 has a front bar 39 and a rotational support 11. The power mechanism is placed on horizontal sector 10, and comprises winding drum 9, reducer 43, electric motor 42, and cable rollers 12—lifting rollers on the lateral sides of horizontal sector 10 and traction rollers on support 41.

Figure 2:
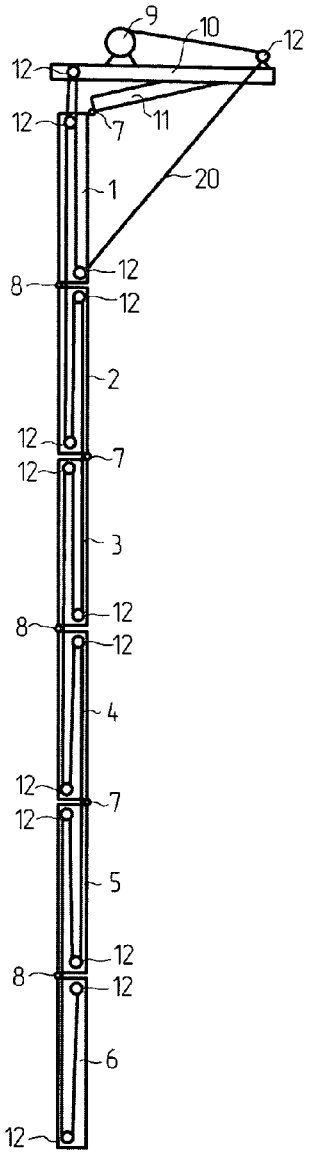
FIG. 2 shows the cable winding and the hinge connection of the panels.

FIG. 2 shows the manner of cable winding and the interconnection of panels with internal hinges 7 and external hinges 8. The door is connected to the horizontal sector 10 via rotary frame 11 with internal line hinges 7.

Figure 3:
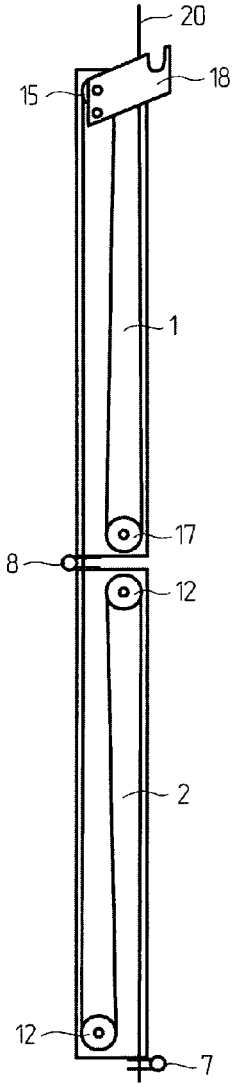
FIG. 3 is a lateral view of the first pair of panels.

FIG. 3 shows the top pair of panels—panel 1 and panel 2—showing the order of roller placement on those panels. The lateral fork hinge 18 is shown at the top of the figure, fixed on axle 13 and anchor jack 19. The cable is wound from the top of the panel through cable rollers 12 and rollers 17.

Figure 4:
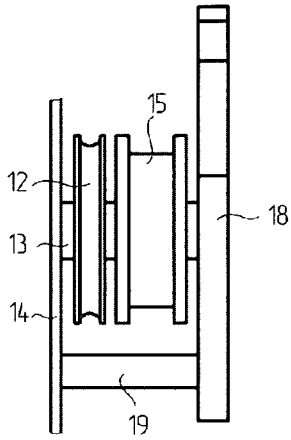
FIG. 4 is a view of the external roller mechanism.
Figure 15:
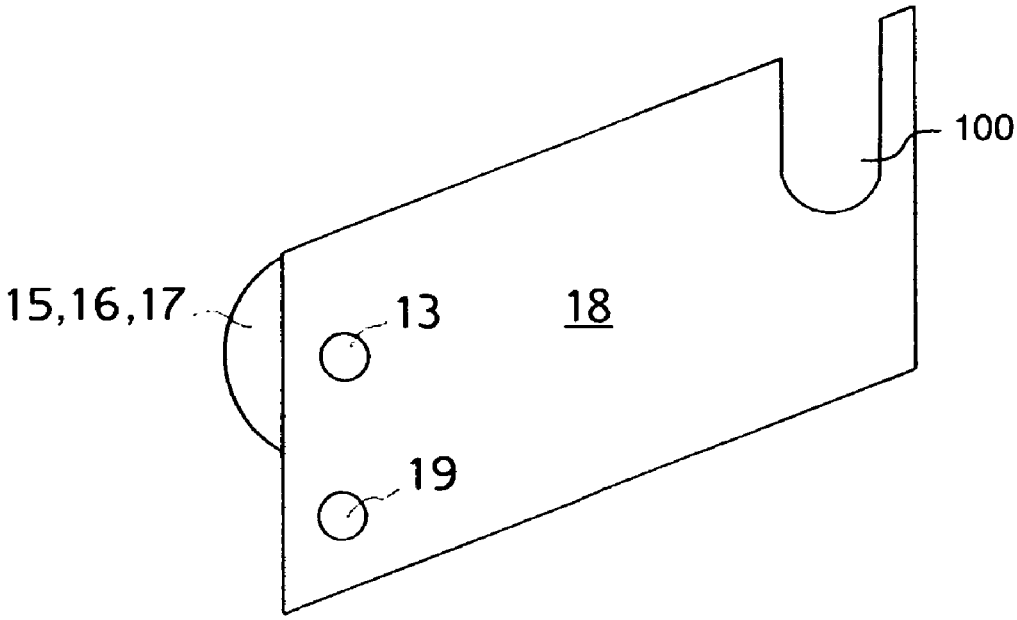
FIG. 15 is a view of the lateral fork hinge with the U-slot.

FIG. 4 shows a side view of the rollers at the top of the first panel. Axle 13 is mounted on the lateral side 14 of the panel. On that axle 13, the following are placed in consecutive order: cable roller 12; roller 15 (for panel 1); and the lateral fork hinge 18 that is fixed on axle 13 and anchor jack 19. FIG. 15 shows an isolated view of the lateral fork hinge 18, which shows the axle 13, anchor jack 19, rollers 15, 16, and 17 (coaxial to axle 13), and the U-slot 100.

Figure 5:
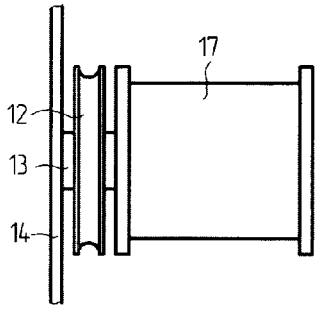
FIG. 5 is a view of the internal roller mechanism.

FIG. 5 shows the internal roller mechanism, which is located in the bottom part of panels 1, 3, and 5. On that axle 13, the following are placed in consecutive order: cable roller 12; roller 17 (for panel 1).

Figure 6:
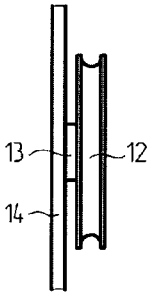
FIG. 6 is a view of the cable roller mechanism.

FIG. 6 shows the cable roller mechanisms placed on panels 2, 4, and 6, comprising one cable roller 12 on axle 13.

Figure 7:
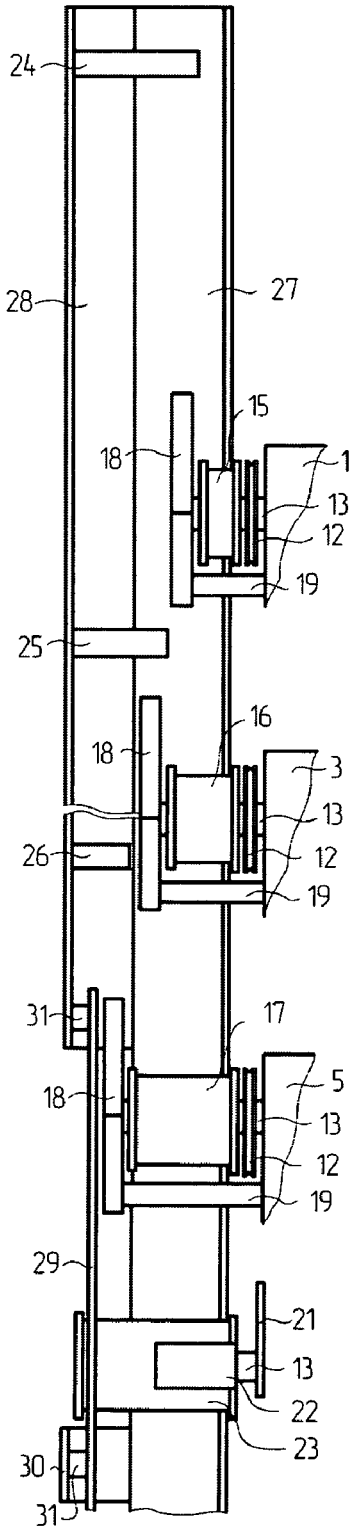
FIG. 7 shows the position of the external roller mechanisms and the end roller n the external rail at a random point within their range of motion.

FIG. 7 shows the vertical correspondence between lateral fork hinges 18 of panels 1, 3, and 5 to axial branches 24, 25, and 26, fixed on platform 28. It also shows the position of end roller 23 and retaining roller 22, mounted on plate 21 to interact with external rail 27 and end roller rail 29, connected via joining element 31 with clamp 30.

Figure 8:
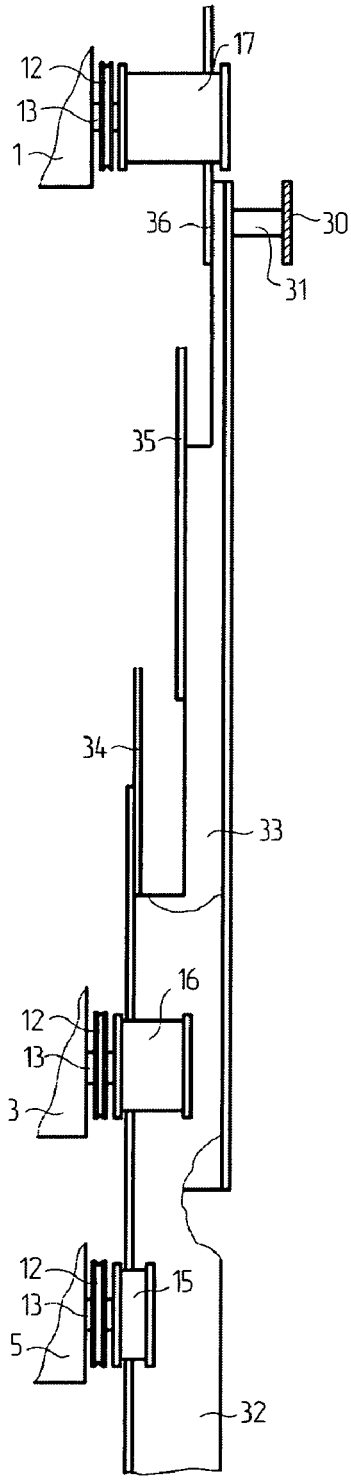
FIG. 8 shows the position of the internal roller mechanisms of the internal rail at a random point within their range of motion.

FIG. 8 shows the relationship of the lengths of rollers 15, 16, and 17 with the circular sectors 34, 35, and 36 and their positions on step bar 33 vis-à-vis internal rail 32.

Figure 9:
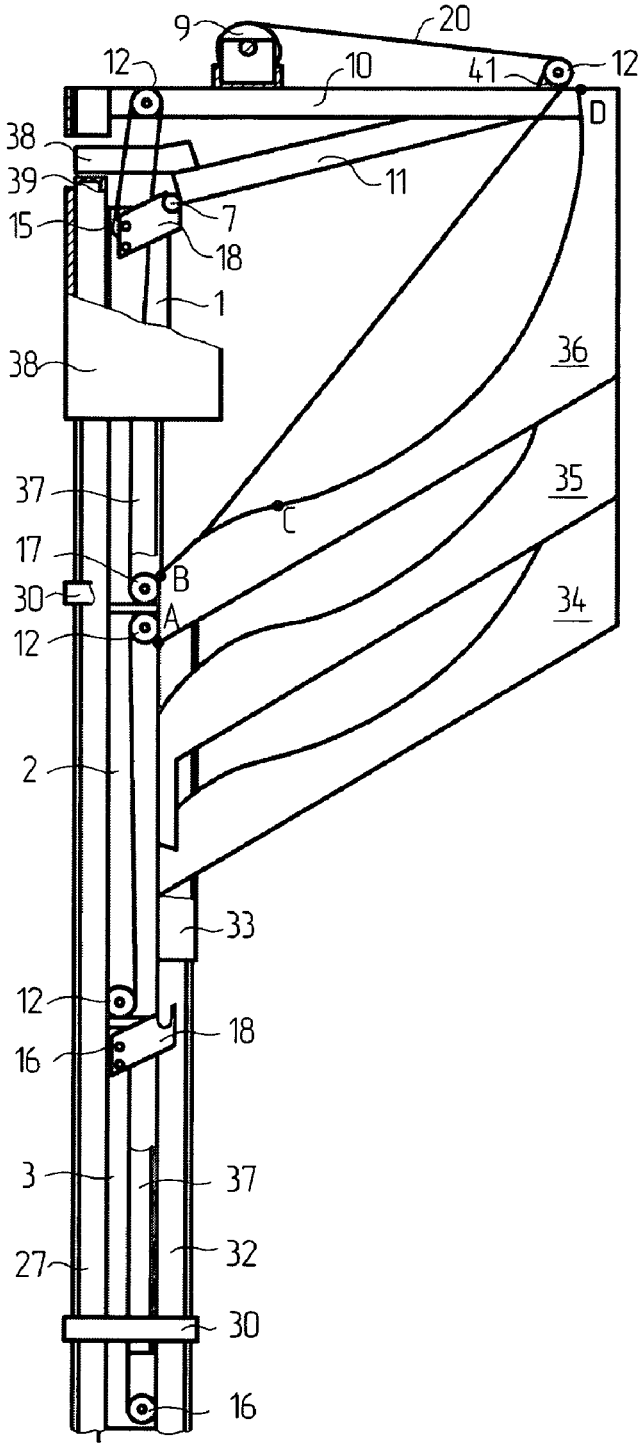
FIG. 9 is a lateral view of the door in the closed position.

FIG. 9 shows the location of the segments on curved sector 36 as follows; AB is the vertical segment, BC is the reverse concavity/inclined segment, and CD is the circular segment. When the door is closed, rotary frame 11 is turned downwards until the limiting elements 38 butt against front bar 39 of horizontal sector 10. At that point, roller 17 of the internal roller mechanism remains on the vertical sector of circular rail 36, preventing the first pair of panels from bending inwards. For other pairs of panels, this function is performed by lateral fork hinges 18, which are thrust against internal rail 32; and for the last panel, this function is performed by the end roller 23 and retaining roller 22. Furthermore, because of gravitational force on the open door and because of the door's structure, each rail roller is strongly pressed against its rail, stabilizing the structure. The edges of the rollers prevent the panels from lateral displacement. While the top panel is slightly turned inward, this does not disturb the panel exterior, as over ⅔ of the panel remains above the aperture.

Figure 10:
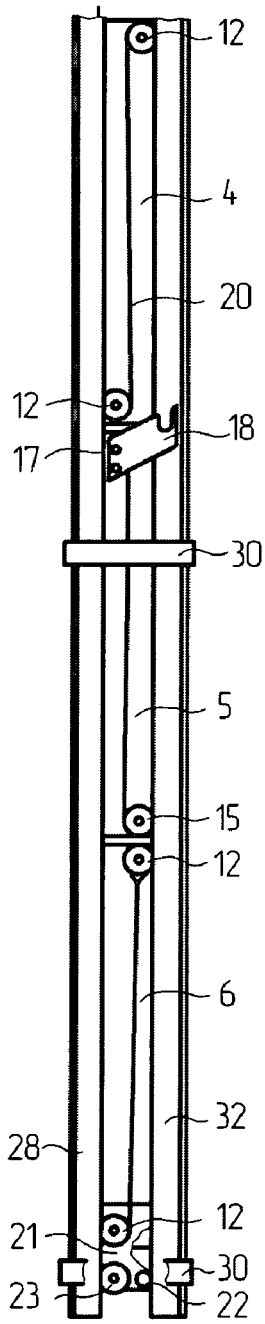
FIG. 10 is another view of FIG. 9.

FIG. 10 is a continuation of FIG. 9, and is a sectional view of the step bar 33, axial branch platform 28, internal rail 27, end roller rail 37, the first and fourth clamp 30 and plate 21.

Figure 11:
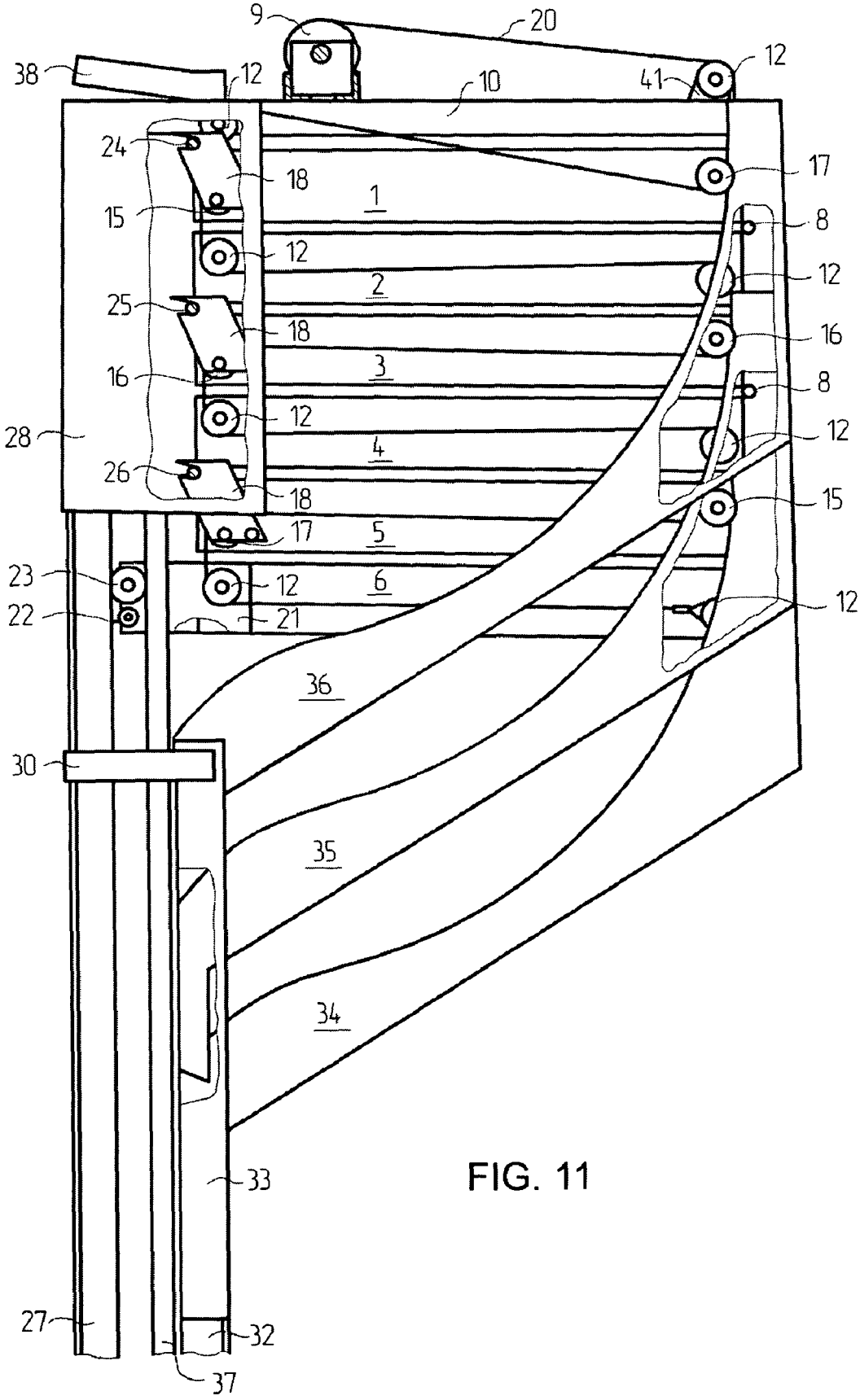
FIG. 11 is a lateral view of the door in the open position.

FIG. 11 shows the door in its open condition. The U-slots of lateral fork hinges 18 of panels 1, 3, and 5 are connected to axial branches 24, 25, and 26. The hinges are turned, and as a result, the folded panels are hanging on axial branches 24, 25, and 26, and cable 20 is holding panels 5 and 6 in a horizontal position. Rollers 17, 16, and 15 of the interal rail roller mechanisms stay on the curved sectors 36, 35, 34, and prevent displacement of the corresponding lateral fork hinge from the axial branch.

Figure 12:
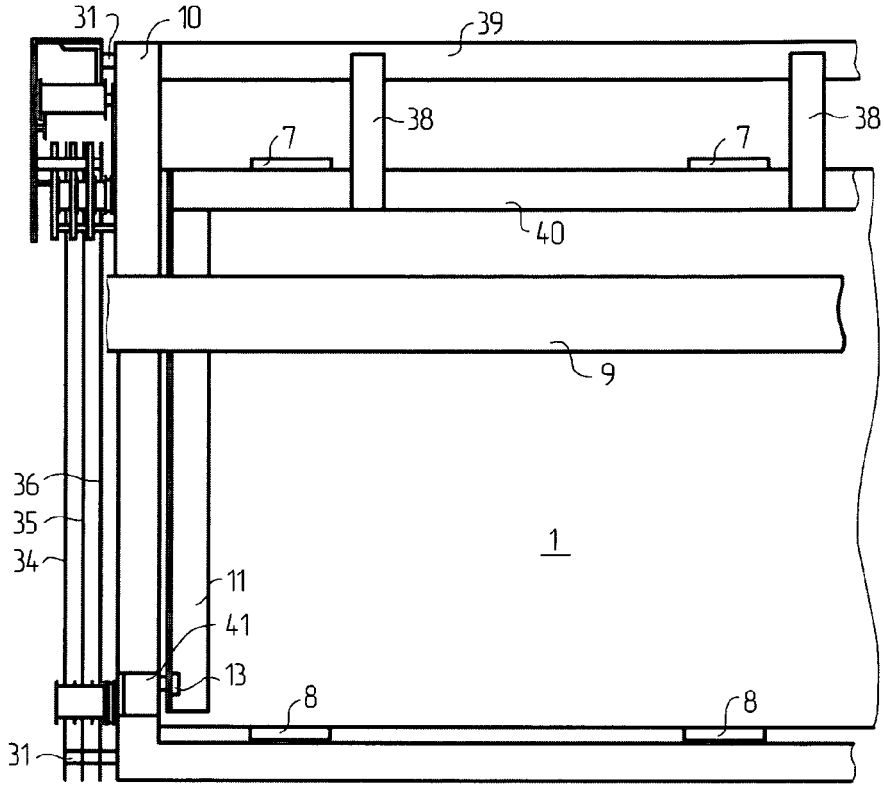
FIG. 12 is a top view of the door in the open position.

FIG. 12 shows a sectional view of the left part of the invention in the door folded position. The lateral side of rotary frame 11 is connected to horizontal sector 10 by axis 13, and the front side 40 is connected to panel 1 by a line of internal hinges 7, with limiting elements 38 placed on it. FIG. 12 also shows two sides of the winding drum 9.

Figure 13:
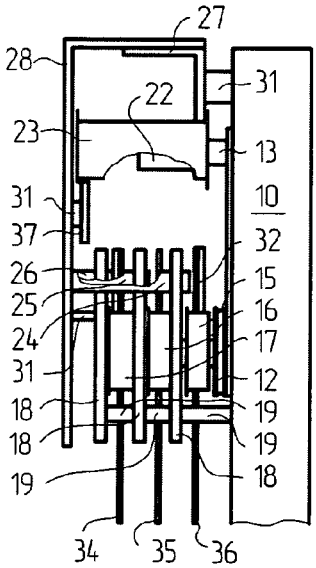
FIG. 13 is a scaled-up view of the external roller mechanisms shown in FIG. 12.

FIG. 13 shows the positional relationship between lateral fork hinges 18 and curved sectors 34, 35, and 36 in the horizontal plane aligned with the section's lateral side, which excludes their mutual touching during the motion of the external roller mechanisms. The Figure shows sectional views of axial branches 24, 25, and 26, and a view of the end roller 23, which is located between end rail roller 37 and external rail 27, and connected to horizontal sector 10 with joining element 31.

Figure 14:
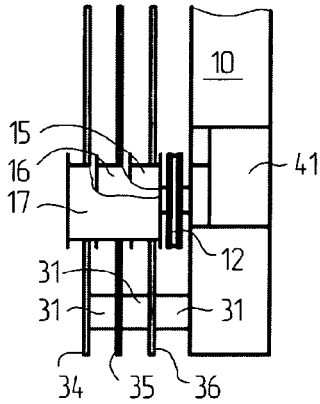
FIG. 14 is a scaled-up view of the internal roller mechanisms shown in FIG. 12.

FIG. 14 shows rollers 15, 16, and 17 of the internal roller mechanisms positioned on curved rails 34, 35, and 36, respectively. Those curved rails are interconnected and connected with horizontal sector 10 via joining elements 31. Cable roller 12, which performs a traction function, is mounted on horizontal sector 10 with support 41.

Figure 16:
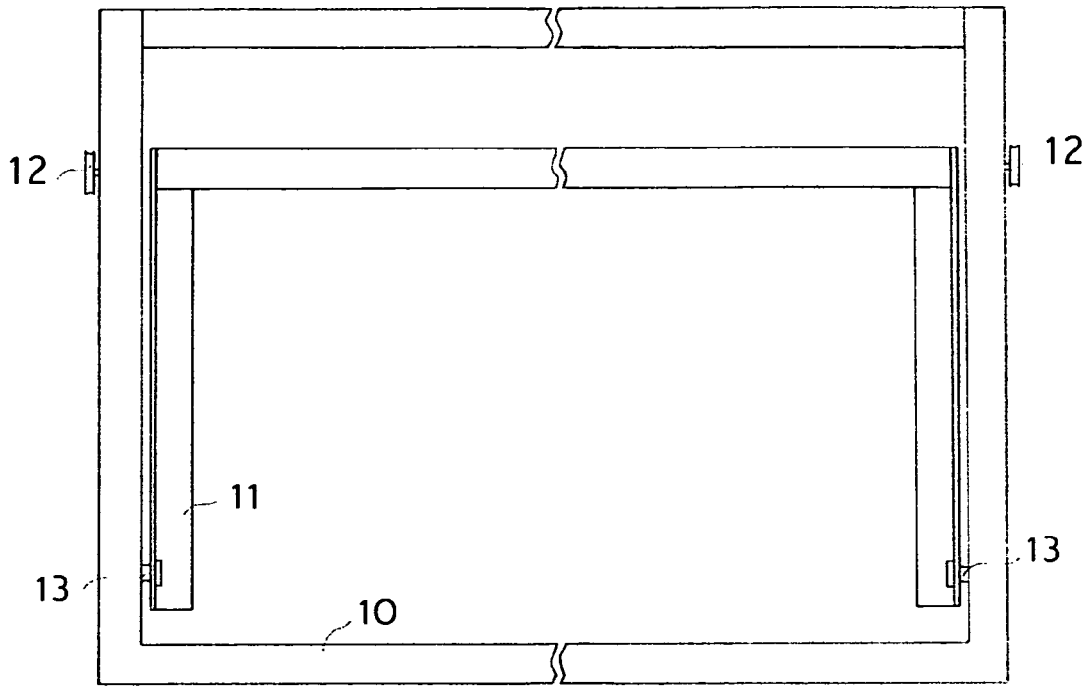
FIG. 16 is a view of the U-shaped rotary section.

FIG. 16 shows a view of the rotary frame 11, two traction rollers 12, horizontal sector 10, and axles 13, in isolation from the other elements for greater clarity.

FIG. 9 shows the door in the completely closed position, and FIG. 11 shows it in the completely open position. To go from closed to open position, electric motor 42 rotates the winding drum 9 via a reducer 43 counterclockwise, which winds cable 20 on winding drum 9. This applies two forces to the first pair of panels—a lateral force, whose vector coincides with cable 20, and which is directed from roller 12 of the first panel's internal roller mechanism to traction cable roller 12; and a vertical force, whose vector coincides with cable 20 and is directed from roller 12 of the external roller mechanism of section 2 to the lifting cable roller 12. The total sum of these two forces exceeds the gravitational force, and the first pair of panels is lifted, rotated, and folded. The process of folding involves three stages. First, the first pair of panels and the whole door starts lifting. At that stage, rotary frame 11 rotates upwards, and roller 17 of the internal roller mechanism of the first panel moves from the vertical segment of curved 36 into the inclination segment. Then, the second stage of the process starts. At that stage, the U-slot of the lateral fork hinge 18 of the first panel engages with the axial branch 24, and roller 17 moves on the inclined segment of the curved sector 36. Finally, during the third stage, roller 17 of the first panel's internal roller mechanism passes the inclined segment and moves on to the circular segment of curved sector 36, the U-slot of the lateral fork hinge 18 becomes completely coaxial with the axial branch 24, and panel 1 rotates around the axial branch 24 until the first pair of panels is completely folded. The other pairs of panels are lifted when the first two panels fold. Panels 3 and 4 fold similarly to panels 1 and 2, except that the lateral force vector is now directed from the roller 12 of the internal roller mechanism of panel 3 to the roller 12 of the internal roller mechanism of panel 2, and the vertical force vector is now directed from roller 12 of the external roller mechanism of panel 4 to roller 12 of the external roller mechanism of panel 3. Panels 5 and 6 fold similarly to panels 3 and 4. Panel 6 is the final panel; as such, it has an end roller 23 and retaining roller 22, placed on plate 21 as shown on FIG. 11. The length of end roller rail 37 is dependent on the linear motion of end roller 23 on external roller 27, when panels 5 and 6 are not coplanar. At the time, retaining roller 22 thrusts against the internal rail 32.

When the door is closing, winding drum 9 rotates clockwise and the cable 20 unwinds. Gravity provides the main force in the process; the force vector is directed straight down from roller 12 of the external roller mechanism of panel 6, as shown in FIG. 11. The bottom edge of panel 6 goes down, end roller 23 moves between external rail 27 and end roller rail 37, and roller 15 of the internal roller mechanism of section 5 goes down along the curved sector 34. Lateral fork hinge 18 of the external roller mechanism of panel 5 rotates on axial branch 26 while this roller passes through the circular segment of curved sector 34. Then, as roller 15 of the internal roller mechanism of panel 5 moves along the inclined segment of curved sector 34, the lateral fork hinge 18 of the external roller mechanism of section 5 starts disengaging from axial branch 26. Then, at the final stage of the process, roller 15 of the internal roller mechanism of panel 5 goes to the vertical segment of curved sector 34 and the internal rail 32, and roller 17 of the external roller mechanism of panel 5 engages with external rail 27. Finally, panels 6 and 5 are completely coplanar and hang downwards. The process is similar for panels 4 and 3 and for panels 2 and 1. At the end of the process, rotary frame 11 is turned until limiting elements 38 butt against front bar 39, and the door closing process is finished.

The invention claimed is:

1. A sectional folding garage door comprising:

an even number of panels connected by hinges;

a plurality of external roller mechanisms, each external roller mechanism placed on the top lateral side of each odd-numbered panel, each comprising an external cable roller, an external rail roller, and a lateral fork hinge, mounted coaxially to each other along a horizontal axis;

a frame comprising two vertical guides and a horizontal sector, said vertical guides comprising an external rail and a plurality of axial branches protruding horizontally from the vertical guides, the number of said axial branches equal to the number of panels, the topmost axial branch being the longest and each successive axial branch being shorter, and an internal rail, said internal rail comprising at least one curved sector with a radius of curvature equal to the vertical dimension of a panel, and said horizontal sector comprising a rotary frame;

a plurality of lateral fork hinges, each lateral fork hinge corresponding to an axial branch, wherein each lateral fork hinge revolves around its corresponding axial branch during folding;

a power mechanism comprising at least one cable, a cable winding drum, and a plurality of rollers situated on at least one of the panels.

2. A sectional folding garage door according to claim 1, wherein said external rail rollers are the shortest for the top-most pair of panels and increase in length for each successive pair of panels.

3. A sectional folding garage door according to claim 1, wherein said curved sectors correspond to internal rail rollers.

4. A sectional folding garage door according to claim 1, wherein said curved sectors include a vertical segment, a reverse concave segment, and a circular arc segment.

5. A sectional folding garage door according to claim 1, wherein the bottommost panel further comprises a retaining roller and an end roller, wherein said end roller is longer than the external rail roller of the same panel.

6. A sectional folding garage door according to claim 1, further comprising a plurality of internal roller mechanisms, one for each pair of panels, each comprising an internal cable roller and an internal rail roller, wherein said internal rail rollers are the longest for the top-most pair of panels and shorter for each successive pair of panels.

* * * * *